US005401201A

United States Patent [19]

Muraki

[11] Patent Number: 5,401,201

[45] Date of Patent: Mar. 28, 1995

[54] MUSIC BOX VEHICLE WITH AUTOMATIC WHEEL SHAFT REVERSING MECHANISM

[75] Inventor: Hiroyuki Muraki, Tokyo, Japan

[73] Assignee: Sankyo Seiki Mfg. Co., Ltd., Nagano, Japan

[21] Appl. No.: 58,568

[22] Filed: May 6, 1993

[51] Int. Cl.[6] ..... A63H 5/00; A63H 29/00

[52] U.S. Cl. ..... 446/409; 446/443; 74/135

[58] Field of Search ..... 446/81, 269–272, 446/409, 431, 432, 443; 74/70–73, 132, 135

[56] References Cited

U.S. PATENT DOCUMENTS

| | | | |
|---|---|---|---|
| 2,667,721 | 2/1954 | Müller | 446/443 |
| 2,909,935 | 10/1959 | Dodge | 74/70 |
| 3,386,406 | 6/1968 | Tsunoda | 446/409 |
| 3,402,505 | 9/1968 | Nakamura | 446/443 |
| 4,285,159 | 8/1981 | Bass et al. | 446/443 |

FOREIGN PATENT DOCUMENTS

| | | | |
|---|---|---|---|
| 2722734 | of 1978 | Germany | 446/443 |
| 51-24492 | 8/1976 | Japan . | |
| 61-111493 | 7/1986 | Japan . | |
| 62-74882 | 5/1987 | Japan . | |
| 23538 | of 1894 | United Kingdom | 446/443 |

*Primary Examiner*—Robert A. Hafer
*Assistant Examiner*—Jeffrey D. Carlson
*Attorney, Agent, or Firm*—McAulay Fisher Nissen Goldberg & Kiel

[57] ABSTRACT

An automatic wheel shaft reversing mechanism comprises a drive gear adapted to be rotatably driven by a driver unit; driven gears are provided which are movable in the axial direction of a wheel shaft and supported thereon, the driven gears alternatively meshing with the drive gear at right angles at two engaging portions, respectively; a cam portion is also provided which is adapted to be rotated by the driver unit to change over the engagement of the drive gear with the two engaging portions of the driven gears; a spring is also provided for biasing the driven gears. The driver unit, in preferred form, is a movement box unit. The reversing mechanism is usable in a variety of toy vehicles.

8 Claims, 6 Drawing Sheets

MUSIC BOX VEHICLE WITH AUTOMATIC WHEEL SHAFT REVERSING MECHANISM

BACKGROUND OF THE INVENTION a) Field of the Invention

The present invention relates to an automatic wheel shaft reversing mechanism for a toy vehicle or the like which capable of reciprocating movement over an arbitrarily preset distance.

b) Related Art

It has thus far been necessary for toy vehicles capable of only forward running to change over their moving direction upon arrival at a predetermined position.

To eliminate this defect, reciprocatory toy vehicles capable of moving back to their starting points when they have moved forward over a predetermined distance have been proposed in 1) Japanese Utility Model Laid-Open Publication No. SHO 51-24492, 2) Japanese Utility Model Laid-Open Publication No. SHO 61-111493, and 3) Japanese Utility Model Laid-Open Publication No. SHO 62-74882, etc.

In the toy vehicle disclosed in the above-mentioned publication 1), the running body thereof is reciprocated, not independently, but in cooperation with guide pieces provided on rails.

In the toy vehicle described in the above-mentioned publication 2), since the forward and backward running of the vehicle is selectively changed over by means of a lever, the vehicle cannot be reciprocated automatically.

Further, the toy vehicle described in the above-mentioned publication 3) has a complicated structure since the running body portion thereof is so arranged that it runs either in a state in which it is laid flat with respect to the running plane or in an erected state.

OBJECT AND SUMMARY OF THE INVENTION

The present invention has been developed to solve the above-mentioned problems, and has for its primary object providing an automatic wheel shaft reversing mechanism for a toy vehicle which is simple in structure and which is yet capable of reciprocating the toy vehicle automatically.

In accordance with the invention, an automatic wheel shaft reversing mechanism comprises a drive gear adapted to be rotatably driven by a driver unit, driven gears movable in the axial direction of a wheel shaft and supported thereon, the driven gears alternatively meshing with the drive gear at right angles at two engaging portions, respectively, a cam portion adapted to be rotated by the driver unit to change over the engagement of the drive gear with the two engaging portions of the driven gears and a spring for biasing the driven gears.

For a better understanding of the present invention, reference is made to the following description and accompanying drawings while the scope of the invention will be pointed out in the appended claims.

DESCRIPTION OF THE PREFERRED EMBODIMENTS

Figure 1:
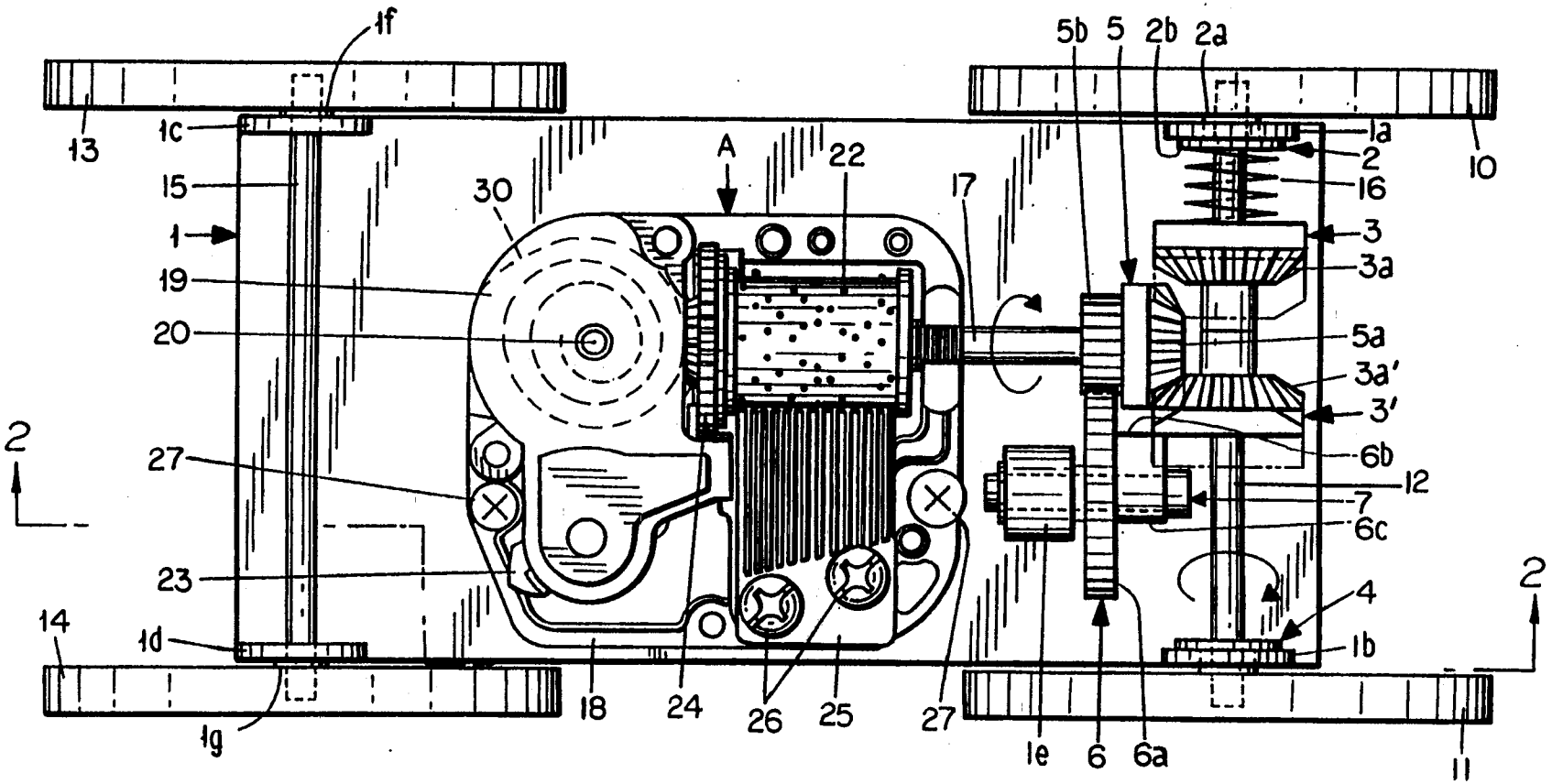
FIG. 1 illustrates a plan view of an automatic wheel shaft reversing mechanism showing the forward running condition of a first embodiment of the present invention.

The present invention will now be described in detail by way of example only with reference to the accompanying drawings.

FIGS. 1 through 5 show a first embodiment of a toy vehicle having an automatic wheel shaft reversing mechanism according to the present invention.

The automatic wheel shaft reversing mechanism comprises bearing plates 1*a*, 1*b*, 1*c*, and 1*d* formed at four corners of a chassis 1, as shown in FIGS. 1 to 4. A wheel shaft 12 having drive wheels 10 and 11 mounted on both ends thereof is journalled in the bearing plates 1*a* and 1*b*.

Further, a wheel shaft 15 having driven wheels 13 and 14 mounted on the ends thereof is journalled in the bearing plates 1*c* and 1*d*.

Figure 2:
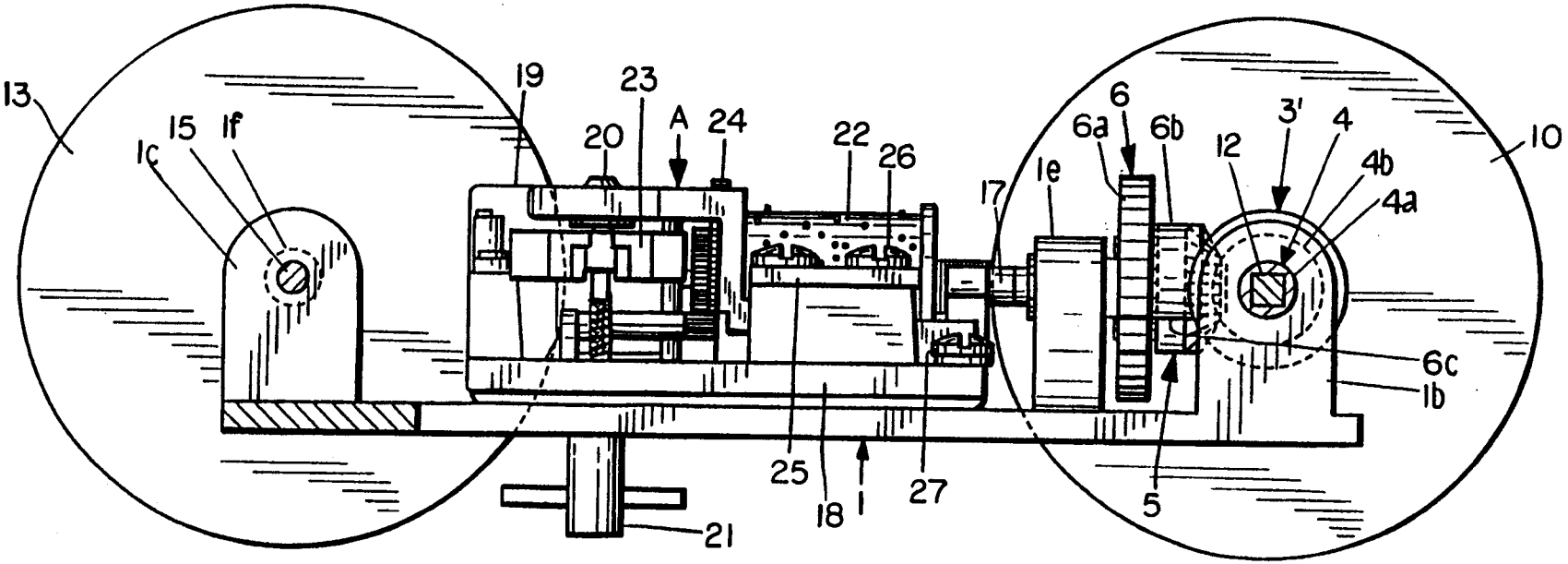
FIG. 2 illustrates a side elevation of the mechanism taken along the line II—II in FIG. 1.

The wheel shaft 12 is square in section as shown in FIG. 2. The wheel shaft 12 has a flanged collar 2 fitted thereon a spring 16, driven gears 3 and 3', each comprised of a crown gear, and a flanged collar 4.

The driven gears 3 and 3' are fitted over the wheel shaft 12 so that they may be slidably moved thereon. A drive gear 5 comprised of a crown gear and a spur gear is disposed between the driven gears 3 and 3' such that a crown gear-shaped engaging portion 5*a* thereof can mesh with either one of the crown gears 3*a* and 3*a'* of the driven gears 3 and 3'.

The drive gear 5 is fixedly secured to a drum shaft 17 of a music box ("orgel") movement "A" serving as a driven unit.

A spur gear 5*b* of the drive gear 5 is engaged with a spur gear 6*a* of a cam gear 6.

A cam portion (which includes a convex cam 6*b* and a concave cam 6*c*) of the cam gear 6 is kept in contact with the rear portion of the driven gear 3'.

The cam gear 6 is replaceably supported by a bearing base 1*e* formed on the chassis 1 through the intermediary of a shaft 7.

Figure 3:
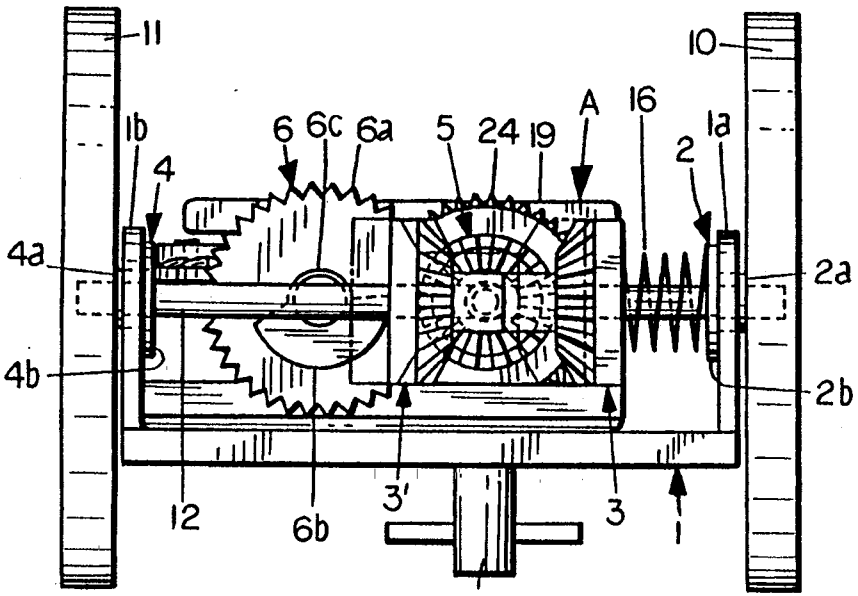
FIG. 3 illustrates a front view of the automatic wheel shaft reversing mechanism according to the first embodiment of the present invention.
Figure 4:
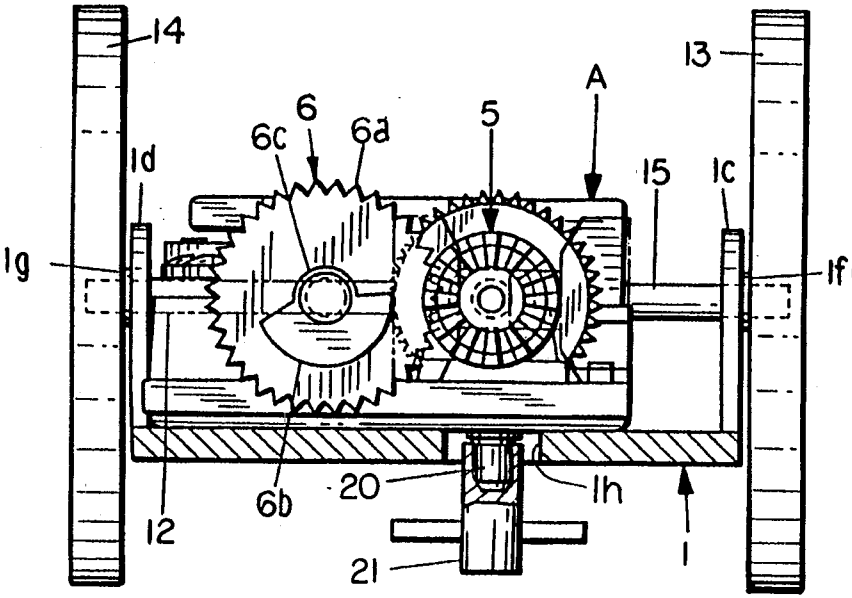
FIG. 4 illustrates a front view partly in section of the automatic wheel shaft reversing mechanism according to the first embodiment of the present invention.

The cam portion of the cam gear 6 is comprised of the large diameter convex cam 6*b* and the small diameter concave cam 6*c*, and when the large diameter convex cam 6*b* is brought into contact with and urged against the rear of the driven gear 3' as shown in FIGS. 1, 3 and 4, the engaging portion 5*a* of the drive gear 5 meshes with the crown gear 3*a'* of the driven gear 3'.

Figure 5:
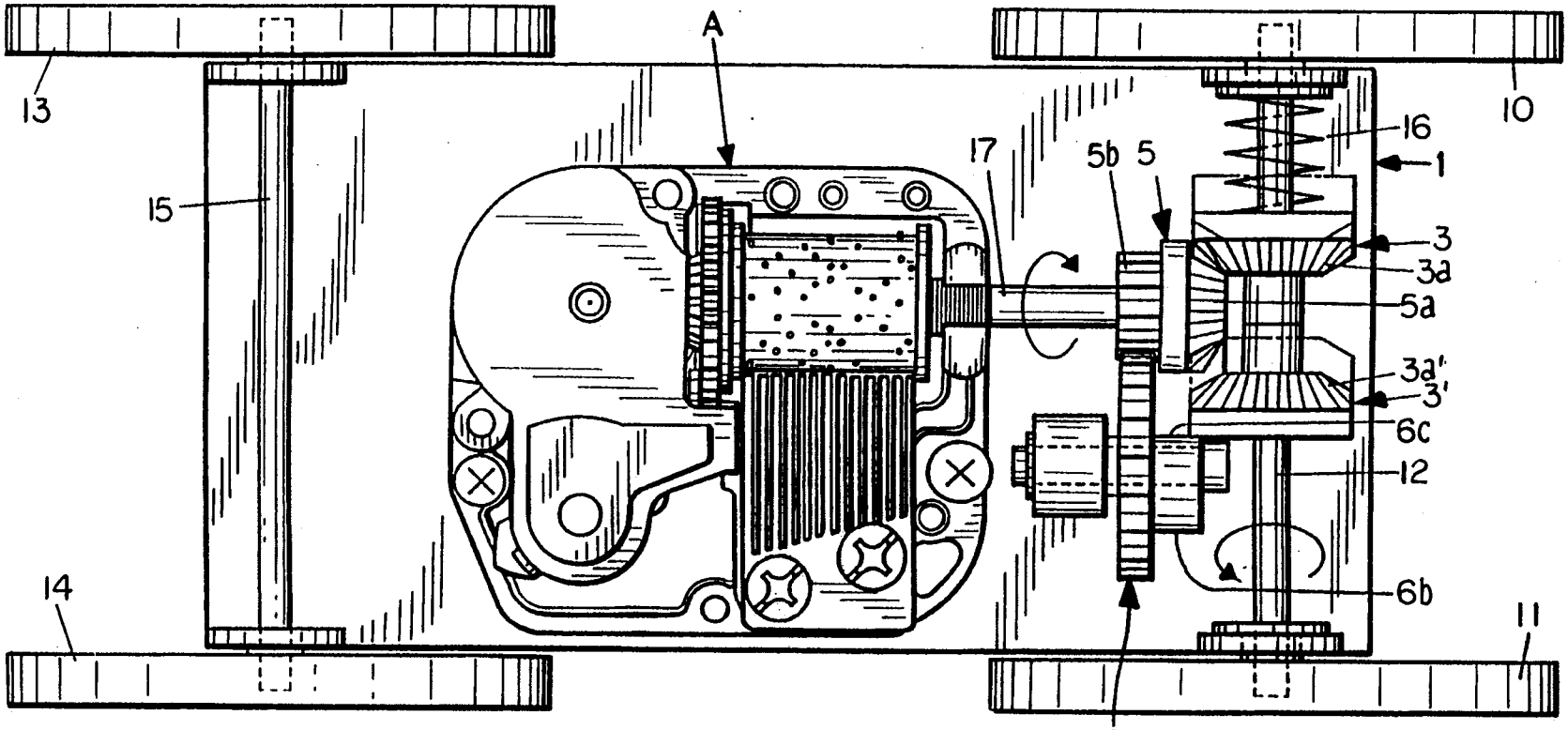
FIG. 5 illustrates a plan view of the automatic wheel shaft reversing mechanism showing backward running condition of the first embodiment of the present invention

Further, when the small diameter concave cam 6*c* is brought into contact with and pressed against the rear portion of the driven gear 3', the engaging portion 5*a* of the drive gear 5 meshes with the crown gear 3*a* of the driven, gear 3 as shown in FIG. 5.

The flanged collars 2 and 4 have collar portions 2*a* and 4*a*, respectively, which are fitted in circular holes formed in the bearing plates 1*a* and 1*b*, respectively. Each of the collar portions 2*a* and 4*a* has a square hole formed therein in which the wheel shaft 12 is fitted.

The flanged collar 2 includes a flange portion 2*b* which is urged against the bearing plate 1*a* by the biasing force of a spring 16. After the wheel shaft 12 is fitted in the square hole formed in the collar portion 4*a*, and the drive wheel 11 is fitted over and fixedly secured to the wheel shaft 12, flange portion 4*b* of the flanged collar 4 is pressed against the bearing plate 1*b*, and then the flanged collar 4 is fixedly secured by an adhesive to the wheel shaft 12.

As an alternative, it is possible to form the portion of the wheel shaft 12 over which the collar portion 4*a* is to be fitted to have a larger outside diameter so that the flanged collar 4 may be press-fitted over the wheel shaft 12.

Further, the collar portions 2*a* and 4*a* of the flanged collars 2 and 4 have lengths larger than the thicknesses of the bearing plates 1*a* and 1*b*, respectively. When the flanged collars 2 and 4 are fitted to the bearing plates 1*a* and 1*b*, respectively, the collars project out of the bearing plates so as to define a clearance between the outside of the bearing plates 1*a* and 1*b*, and the drive wheels 10 and 11, respectively.

At the same time, projecting portions 1*f* and 1*g* are formed on the outside (towards the driven wheels 13 and 14) of the bearing plates 1*c* and 1*d*, thus creating a clearance between the bearing plates 1*c* and 1*d* and the driven wheels 13 and 14, respectively.

The music box movement A serving as the driver unit has a well known structure. A spring 30 (shown schematically in FIG. 1) mounted in a spring case 19 on a frame 18 is fastened to the spring case 19 and a wind-up shaft 20, respectively. A wind-up key 21 is screw-fitted over the wind-up shaft 20. The wind-up key 21 projects out from a through-hole 1*h* formed in the chassis 1.

A drum 22 having a plurality of pins provided to a program is carried by a drum shaft 17 whose one end is rotatably supported on the side wall of the spring case 19 provided on the frame 18. The drum 22 is rotated by the spring serving as the driver unit while its rotating speed is governed by a speed governing section 23 provided in the spring case 19.

A spur gear 24 is secured at one end of the drum 22, and a reduction gear is provided between the spur gear 24 and the speed governing section 23.

Further, a vibration plate 25 adapted to be sprung by the pins of the drum 22 is secured onto the frame 18 by means of screws 26. When the vibrating plate 25 is sprung by the pins of the drum 22 which is rotating while its speed is governed by the speed governing section 23, the music box movement A is actuated to play.

The frame 18 of the above-mentioned music box movement A is secured to the chassis 1 by means of screws 27.

The operation of the automatic wheel shaft reversing mechanism is as follows.

First of all, when the spring serving as the driver unit is wound up by the wind-up key 21 of the music box movement A, and then released, the drum shaft 17 is rotated in one direction by the releasing force of the spring to thereby actuate the music box movement A to play, and also the drive gear 5 is rotated in one direction in accordance with the rotation of the drum shaft 17.

Rotation of the spur gear 5*b* of the drive gear 5 causes rotation of the spur gear 6a of the cam gear 6, so that when the large diameter convex cam 6*b* is brought into contact with and urged against the rear portion of the driven gear 3′, as shown, for example, in FIGS. 1, 3 and 4, the engaging portion 5*a* of the drive gear 5 meshes with the crown gear 3*a*′ of the driven gear 3′, thereby rotating the drive wheels 10 and 11 in the forward running direction (in the direction of movement from left to right in FIG. 1).

With continued rotation of the spur gear 5*b* of the drive gear 5 in one direction, the rear portion of the driven gear 3′ is disengaged from the large diameter convex cam 6*b* and instead engaged with the small diameter concave cam 6*c*.

That is to say, the driven gears 3 and 3′ are moved by the biasing force of the spring 16 on and along the wheel shaft 12 in a direction from the drive wheel 10 towards the drive wheel 11 with the result that the rear portion of the driven gear 3′ comes into contact with the small diameter concave cam 6*c*, as shown in FIG. 5.

When the small diameter convex cam 6*c* is brought into contact with and urged against the rear portion of the driven gear 3′ as described above, the engaging portion 5*a* of the drive gear 5 meshes with the crown gear 3*a* of the driven gear 3, thereby rotating the drive wheels 10 and 11 in the backward running direction (in the direction of movement from right to left in FIG. 5).

Consequently, the forward and backward movement distances are set by the ratio of the arc angle of the large diameter convex cam 6*b* to that of the small diameter concave cam 6*c* so that reciprocation of the toy vehicle is repeated automatically.

With the above-mentioned arrangement of the automatic wheel shaft reversing mechanism, reciprocation of the toy vehicle can be repeated automatically with its simple construction.

Figure 6:
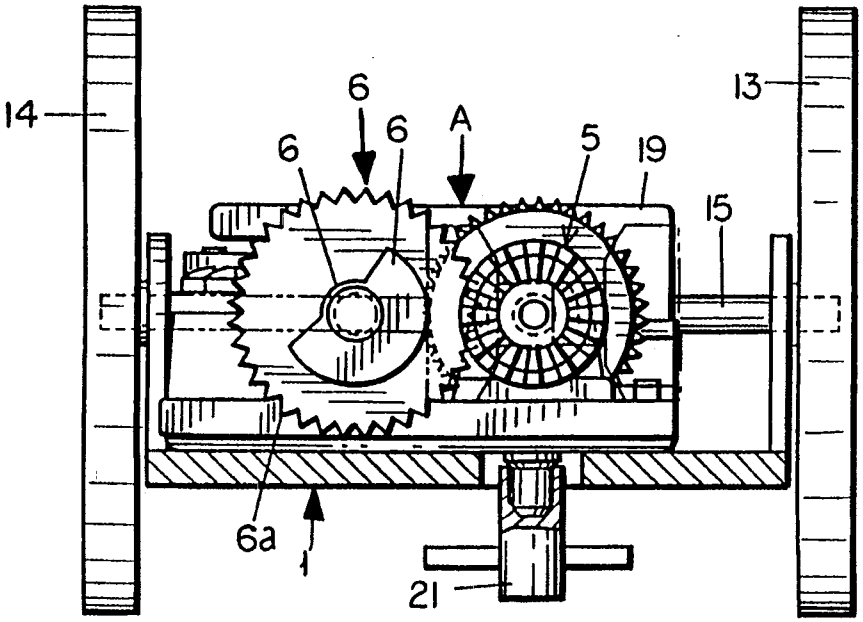
FIG. 6 illustrates a front view partly in section of the automatic wheel shaft reversing mechanism showing a modification wherein the ratio of the convex cam to the concave cam is modified.

FIG. 6 shows a modification wherein the arc angle ratio of the concave cam to that of the convex cam in the first embodiment is modified and the arc angle of the large diameter convex cam 6*b* is formed larger than that of the small diameter concave cam 6*c*.

The arc angle of the large diameter convex cam 6*b* may be formed smaller than that of the small diameter convex cam 6*c* as compared with the case of the first embodiment and at the reverse ratio.

Further, if the arc angle of the ratio of the large diameter convex cam 6*b* to that of the small diameter concave cam 6*c* is set substantially at unity, the forward movement distance becomes nearly equal to the backward movement distance so that the toy vehicle can be returned to the starting point.

Figure 7:
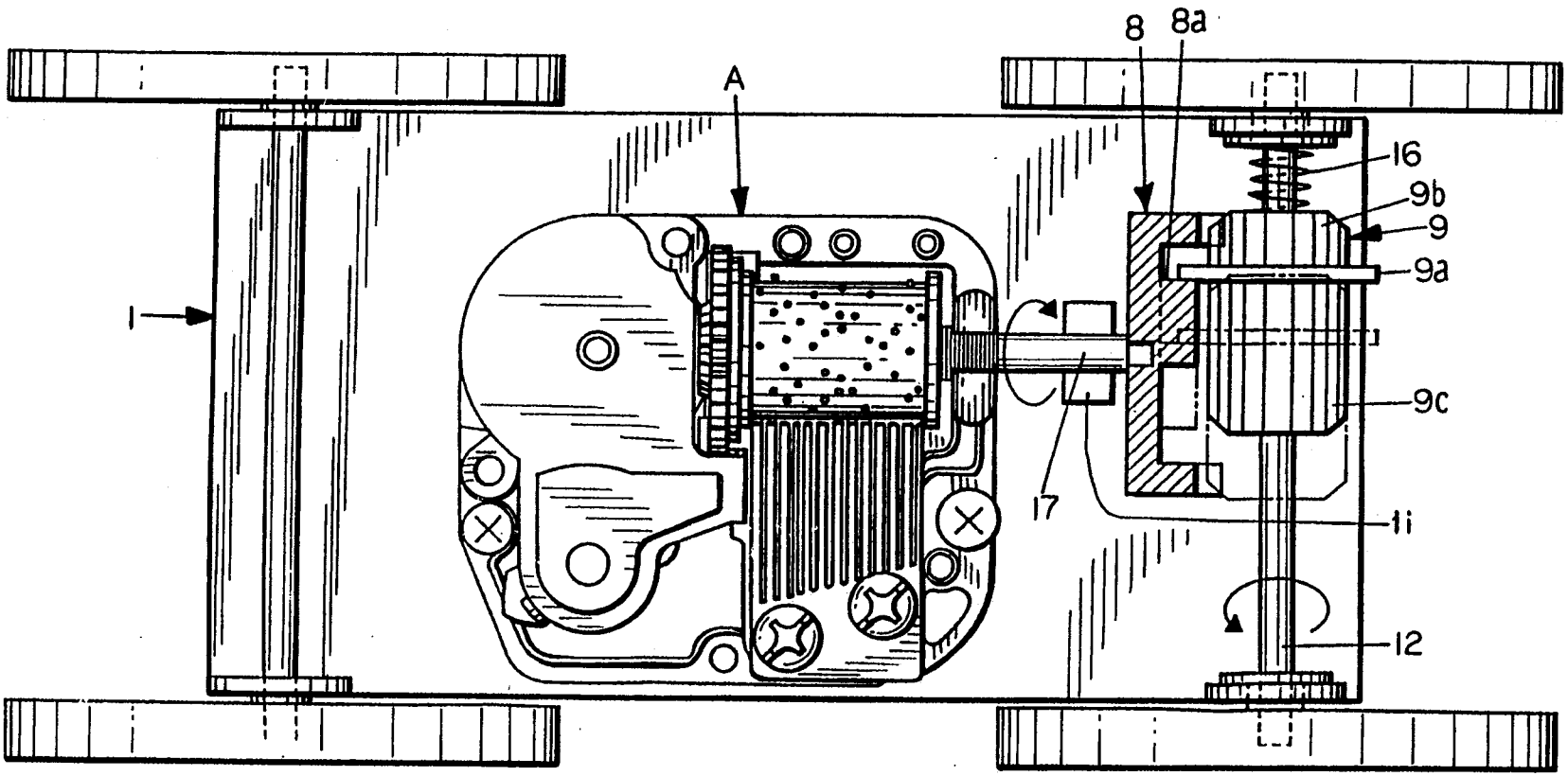
FIG. 7 illustrates a plan view of a second embodiment of the automatic wheel shaft reversing mechanism in the backward running condition, according to the present invention.

FIG. 7 shows a second embodiment of the automatic wheel shaft reversing mechanism according to the present invention.

In the second embodiment, drive gear 8 is in the form of a crown gear having a cam portion. The cam portion is formed inside of the drive gear 8, and is comprised of a large diameter convex cam 8*a* and a small diameter concave cam 8*b* which have similar shapes to those of the abovementioned first embodiment, for example.

The drive gear 8 meshes with a driven gear 9 which has a longitudinal dimension in the axial direction of the wheel shaft 12, and further defines, in the diametral direction thereof, a spur gear whose size allows it to become engageable with the above-mentioned drive gear 8. This driven gear 9 is fitted over the wheel shaft 12 of a square section so that it may be slidably moved freely thereon.

Further, the driven gear 9 is formed with a disk-shaped flange portion 9*a* having a larger diameter than that of the spur gear in the diametral direction thereof.

Moreover, the axial length of the flange portion 9*a* is shorter than that of the above-mentioned spur gear, as shown in FIG. 8.

The drive gear 8 is secured to the drum shaft 17 which is rotatably held by a holder base 1*i* formed on the chassis.

The driven gear 9 is comprised of engaging portion 9*b* and 9*c* formed on both sides of the flange portion 9*a* and which mesh with the drive gear 8.

The operation of the second embodiment is as follows.

When the large diameter convex cam 8*a* of the drive gear 8 is brought into contact with and urged against the flange portion 9*a* as shown in FIG. 8, the drive gear 8 meshes with the engaging portion 9*b*, thereby rotating the wheel shaft 12 in a direction to rotate the drive wheels in the backward running direction (in the direction of movement from right to left in FIG. 7).

Further, when the small diameter concave cam 8*b* of the drive gear 8 is brought into contact with and urged against the flange portion 9*a*, the drive gear 8 meshes with the engaging portion 9*c*, thereby rotating the wheel shaft 12 in such a direction as to rotate the drive wheels in the forward running direction (in the direction of movement from left to right in FIG. 7).

While in the foregoing description the spring of the music box movement A is used as the driver unit, an electric motor may also be used as the driver.

Further, by using the music box movement A as the driver unit, the player can enjoy both the sound of the music box and the reciprocating movement of the toy vehicle at the same time.

The wheel shaft 12 may be in a shape other than square, which permits the driven gears to be moved freely, in the axial direction thereof while preventing them from rotating.

Further, the present invention can be used for toy vehicles, airplanes and ships, etc.

According to the present invention constructed as mentioned above, it becomes possible to provide an automatic wheel shaft reversing mechanism which brings forth an excellent effect which allows for the repetition of automatic reciprocations of the toy vehicle in spite of its simple structure.

While the foregoing description and drawings represent the preferred embodiments of the present invention, it will be obvious to those skilled in the art that various changes and modifications may be made therein without departing from the true spirit and scope of the present invention.

What is claimed is:

1. An automatic wheel shaft reversing mechanism comprising:

a drive gear rotatably driven by a driver unit;

driven gears movable in the axial direction of a wheel shaft and supported thereon, said driven gears alternatively meshing with said drive gear at right angles at two engaging portions, respectively; said wheel shaft being square in section;

a cam portion rotated by said driver unit and having two different cam elements, each element operable at different times, to change over the engagement of said drive gear with the two engaging portions of said driven gears; and a spring mounted on said wheel shaft for biasing said driven gears in an axial direction of the wheel shaft.

2. The automatic wheel shaft reversing mechanism as claimed in claim 1, wherein said driver unit comprises a spring.

3. The automatic wheel shaft reversing mechanism as claimed in claim 2, wherein said driver unit is a music box movement.

4. The automatic wheel shaft reversing mechanism as claimed in claim 1, wherein said cam portion is replaceably provided.

5. The automatic wheel shaft reversing mechanism as claimed in claim 1, wherein said cam portion comprises a large diameter convex cam and a small diameter concave cam.

6. The automatic wheel shaft reversing mechanism as claimed in claim 5, wherein the ratio of the respective angle of the large diameter convex cam to that of the small diameter concave cam is substantially unity.

7. The automatic wheel shaft reversing mechanism as claimed in claim 1, wherein said wheel shaft is fitted in flanged collars.

8. In a toy vehicle having a wheel shaft, the improvement comprising an automatic wheel shaft reversing mechanism including:

a drive gear rotatably driven by a driver unit;

driven gears movable in an axial direction of said wheel shaft and supported thereon, said driven gears alternatively meshing with the drive gear at right angles at two engaging portions respectively; said wheel shaft being square in section;

a cam portion rotated by said driver unit and having two different cam elements, each element operable at different times, to change over the engagement of said drive gear with the two engaging portions of said driven gears; and a spring mounted on said wheel shaft for biasing said driven gears in an axial direction of the wheel shaft.

* * * * *